US006959507B2

(12) United States Patent
Bazany et al.

(10) Patent No.: US 6,959,507 B2
(45) Date of Patent: Nov. 1, 2005

(54) INJECTION MOLDED, RECESSED INSERT FOR USE IN A CONTAINER AND METHOD OF USING SAME

(76) Inventors: Donald J. Bazany, 17649 Tamarack La., Grand Haven, MI (US) 49417; Roger Phillips Carver, 1046 Woodmount, Gallatin, TN (US) 37066

( * ) Notice: Subject to any disclaimer, the term of this patent is extended or adjusted under 35 U.S.C. 154(b) by 70 days.

(21) Appl. No.: 10/679,618

(22) Filed: Oct. 6, 2003

(65) Prior Publication Data

US 2004/0068907 A1 Apr. 15, 2004

Related U.S. Application Data

(60) Provisional application No. 60/417,679, filed on Oct. 10, 2002.

(51) Int. Cl.[7] ..... G09F 3/00
(52) U.S. Cl. ..... 40/312; 40/642.02; 206/459.5
(58) Field of Search ..... 40/312, 642.02, 40/629, 654.01; 220/694, 729

(56) References Cited

U.S. PATENT DOCUMENTS

| | | | | |
|---|---|---|---|---|
| 2,029,221 | A * | 1/1936 | Burgess et al. | 40/574 |
| 2,360,997 | A * | 10/1944 | Winston | 40/642.02 |
| 4,648,548 | A * | 3/1987 | Shin | 229/116.4 |
| 5,584,133 | A * | 12/1996 | Motooka et al. | 40/642.02 |
| 5,640,790 | A * | 6/1997 | Johns | 40/324 |
| 6,305,601 | B1 | 10/2001 | Bazany et al. | |
| 6,349,877 | B1 | 2/2002 | Bradford | |
| 6,460,724 | B1 | 10/2002 | Bradford | |
| 6,478,336 | B2 * | 11/2002 | Tran | 281/29 |
| 6,547,127 | B2 | 4/2003 | Bradford et al. | |

* cited by examiner

*Primary Examiner*—Joanne Silbermann
(74) *Attorney, Agent, or Firm*—Wood, Herron & Evans, LLP

(57) ABSTRACT

An injection molded, recessed insert is disclosed which is adapted to receive and hold a label or label holder. The insert may be snap-locked in an opening in a container such as a tote box. The insert provides a recessed area for the label or label holder so the label or label holder is not removed or ripped off of the container wall when contacted by another object. In one embodiment a cover is hinged to the recess.

14 Claims, 3 Drawing Sheets

INJECTION MOLDED, RECESSED INSERT FOR USE IN A CONTAINER AND METHOD OF USING SAME

CROSS-REFERENCE TO RELATED APPLICATIONS

This application claims priority to U.S. provisional patent application Ser. No. 60/417,679 filed Oct. 10, 2002 entitled "INJECTION MOLDED, RECESSED INSERT FOR USE IN A CONTAINER", the disclosure of which is fully incorporated herein.

FIELD OF THE INVENTION

This invention relates to containers such as tote boxes made from foldable box blanks and having self-locking top rails. More particularly, this invention relates to label holders for use with such tote boxes.

BACKGROUND OF THE INVENTION

Containers which are returnable/reusable are useful for the transportation, storage, and display of goods in commerce. Such containers, commonly called tote boxes, must be of sufficiently rigid construction to enable safe and damage free transport and storage of goods contained therein. These tote boxes are frequently designed so as to be stacked or mounted in a nesting relation for convenient transportation or storage of the tote boxes. In order to be stackable, the upper edge of the container or tote box is typically reinforced with a top rail or rim member which is adapted to receive another tote box stacked thereupon. For example, applicant's U.S. Pat. No. 6,305,601, which is fully incorporated herein, discloses a unitary top rail adapted to fit over the tops of the box walls. In addition, applicant's U.S. Pat. Nos. 6,349,877, 6,460,724; and 6,547,127, each of which is fully incorporated herein, each disclose a top rail made up of several pieces including four corner pieces.

It is conventional to use a variety of materials for the construction of such tote boxes. Such materials typically consist of corrugated paperboard, corrugated plastic sheet, sheet metal and other such materials.

Typically, in order to identify the contents of a container such a tote box, a plastic label holder is taped, glued or otherwise secured to the outer surface of the container or box. The label holder has a thickness so that it projects outwardly from the generally planar outer surface of the tote box wall. When the tote box is moving down an assembly line or being transported, the label holder may catch or snag on items in an undesirable manner. For example, one tote box may catch on the label holder of an adjacent tote box and cause the label holder to tear off. Another possibility is that the tote box may turn over spilling the contents of the tote box when the projecting label holder attached to the tote box catches on something. In addition, the assembly line may have to be shut down, thereby reducing productivity and wasting time. Consequently, the present practice of attaching label holders directly to the container wall may add cost and manufacturing time to the manufacturing process in which the container is used thereby reducing efficiencies in the manufacturing process.

Accordingly, it is a primary objective of the present invention to provide a label holder insert for use with a container which does not project beyond the outer surface of the container walls.

Another objective of this invention has been to provide such an injection molded label recess holder for use with a box or container which may be quickly and easily inserted into existing boxes or containers.

SUMMARY OF THE INVENTION

The present invention is directed to an injection molded, recessed plastic insert adapted to be secured in an opening in a wall of a box or container. The insert is adapted to be located in the opening in a snap fit manner quickly and easily. The insert may be further secured in the opening with at least one rivot, double sided tape, or at least one sonic weld. The insert has a recess which is adapted to receive and hold a label holder or a label in order to identify the contents of the box or container.

The injection molded plastic label holder insert has a generally rectangular recess adapted to receive a label holder. The rectangular recess is defined by a rear portion and a wall extending forwardly from the rear portion around the perimeter of the rear portion. The wall includes a lower wall portion, an upper wall portion and a pair of side wall portions.

Extending downwardly from the front of the lower wall portion of the recess are a pair of spaced front tabs. The front surface of these tabs may contain the manufacturer's trademark or other identifying symbols, words or letters. Between the front tabs and spaced rearwardly from the front tabs a distance equal to the thickness of the tote box wall is a rear tab. The rear tab extends downwardly from the lower wall portion of the recess like the front tab. In one preferred embodiment of the present invention, the front and rear tabs are similarly sized. However, they may be different sizes without departing from the spirit of the present invention.

A pair of side tabs extend outwardly from the front edges of the side wall portions of said recess. These tabs are designed to abut the front surface of the box wall and help secure the label holder insert in place.

A top flange extends upwardly from the rear portion of the recess. The top flange may have a hole centrally located therethrough adapted to receive a fastener such as a rivet. The top flange provides a stop which abuts the inside surface of the box wall when the insert is seated or secured in place. The top flange of the insert may be rivoted, taped, or sonic welded to the box wall. Alternatively, the top flange of the insert may be pinched or trapped between the box wall and the top rail of the box in order to further secure the insert in the opening of the box wall.

In front of the top flange are a pair of spaced catches extending upwardly from the front of the upper wall portion of the recess. These catches are adapted to abut the front surface of the box wall after the insert is snap-locked in the opening of the box wall.

In practice, the box wall below the opening in the box wall is received between the front and rear tabs of the insert. The insert is then pushed forwardly from the inside of the box, causing the catches to push past the tote box wall and snap in place in front of the tote box wall above the wall opening. When the insertion is done, the box wall rests between the top flange of the insert which abuts the inside surface of the box wall and the catches which abut the outside surface of the box wall.

One advantage of the present invention is that a label holder may be quickly and easily put on a container such as a tote box without worrying about whether the label holder will catch on nearby exterior surfaces. The insert of the present invention provides a recessed area within a container where a customer may place labels or label holders that are recessed from the outside surface of the container, preventing the label or label holder from being removed or ripped off from surface-to-surface contact with containers, conveyors, etc. Another advantage of the present invention is that label holders may be changed more quickly and less expensively than is presently possible in competitive type tote boxes.

An alternative preferred embodiment of the present invention has a cover hinged to the insert to protect a label resting in the recess from the elements. The cover may be locked in place via a locking mechanism to prevent the cover from opening. The cover is preferably hinged to the lower wall portion of the recess, but may be hinged in alternative locations.

BRIEF DESCRIPTION OF THE DRAWINGS

The objectives and features of the present invention will become more readily apparent when the following detailed description of the drawings is taken in conjunction with the accompanying drawings in which.

DETAILED DESCRIPTION OF THE DRAWINGS

Figure 1:
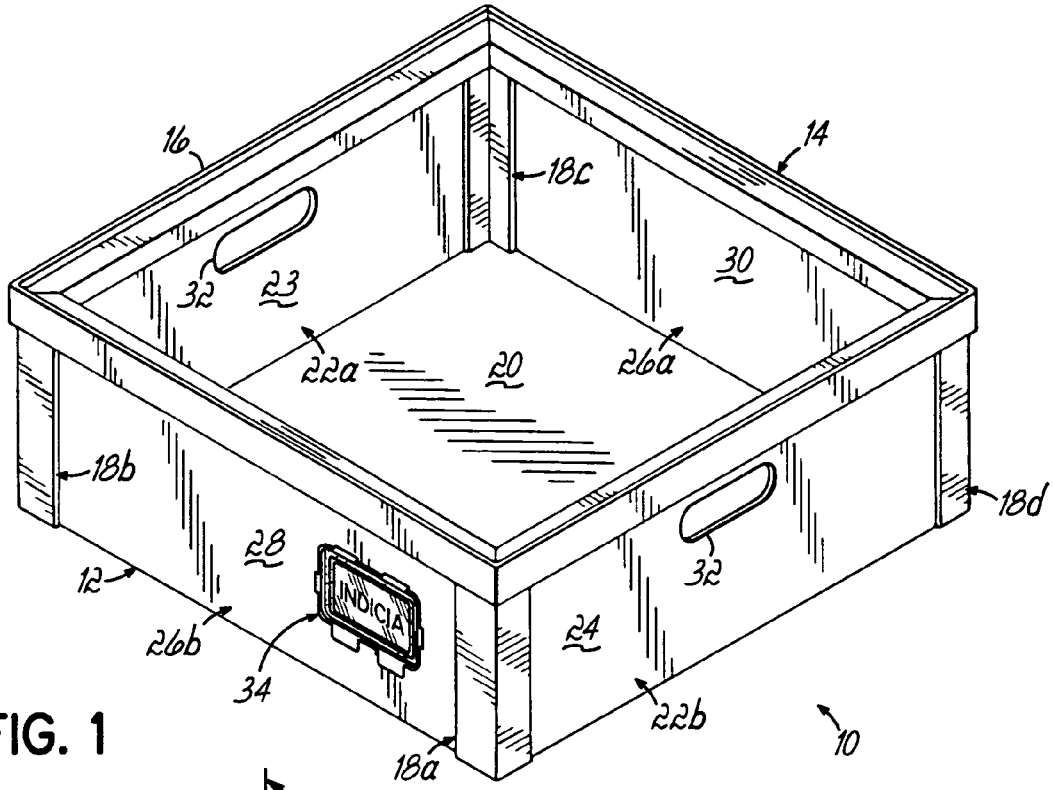
FIG. 1 is a perspective view of an assembled tote box with the injection molded label holder of the present invention.

Referring to FIG. 1, there is illustrated an assembled tote box 10 according to the present invention. The tote box 10 is assembled from a uniform thickness box blank (not shown) which is die cut or otherwise pre-cut from, preferably, corrugated plastic sheet. However, the box blank and resulting box may be made from any other suitable material. In one preferred embodiment, the box blank is 5 millimeters thick and made from extruded corrugated plastic material. Depending upon the application, the box blank may be other thicknesses or materials as well.

As best illustrated in FIG. 1, the tote box 10 comprises a box 12 formed from the foldable box blank (not shown), a top rail 14 having an upwardly extending outer lip 16 which facilitates stacking multiple tote boxes, and four corner enhancers 18*a*–18*d*. The top rail 14 may be a unitary piece as shown or made of multiple pieces.

Referring to FIG. 1, the box 12 has a bottom 20, two end walls 22*a* and 22*b*, and two side walls 26*a*,26*b*. The end walls 22*a*, 22*b* each have an outside surface 24 and an inside surface 23. Similarly, each of the side walls 26*a*, 26*b* have an outside surface 28 and an inside surface 30. The end walls 22*a*, 22*b* may be the same length as the side walls 26*a*, 26*b*, resulting in a square box. Alternatively, the length of the end walls 22*a*, 22*b* may be different than the length of the side walls 26*a*, 26*b*, resulting in a rectangular box.

Oval shaped holes 32 are cut through the end walls 22*a*, 22*b* and may accommodate hand holds (not shown) which preferably are fabricated from plastic or aluminum but may be constructed of any material. Although the holes 32 are illustrated as being formed in the end walls 22*a*, 22*b*, they may alternatively be placed in the side walls 26*a*, 26*b*.

As shown in FIG. 1, at least one of the tote box walls has injection molded label holder insert 34 of the present invention secured therein. Although FIG. 1 illustrates the injection molded label holder insert 34 located in end wall 26*b*, it may be located in any one or multiple tote box walls. Similarly, the injection molded label holder insert 34 may be used in any type or configuration of container other than tote boxes.

Figure 2:
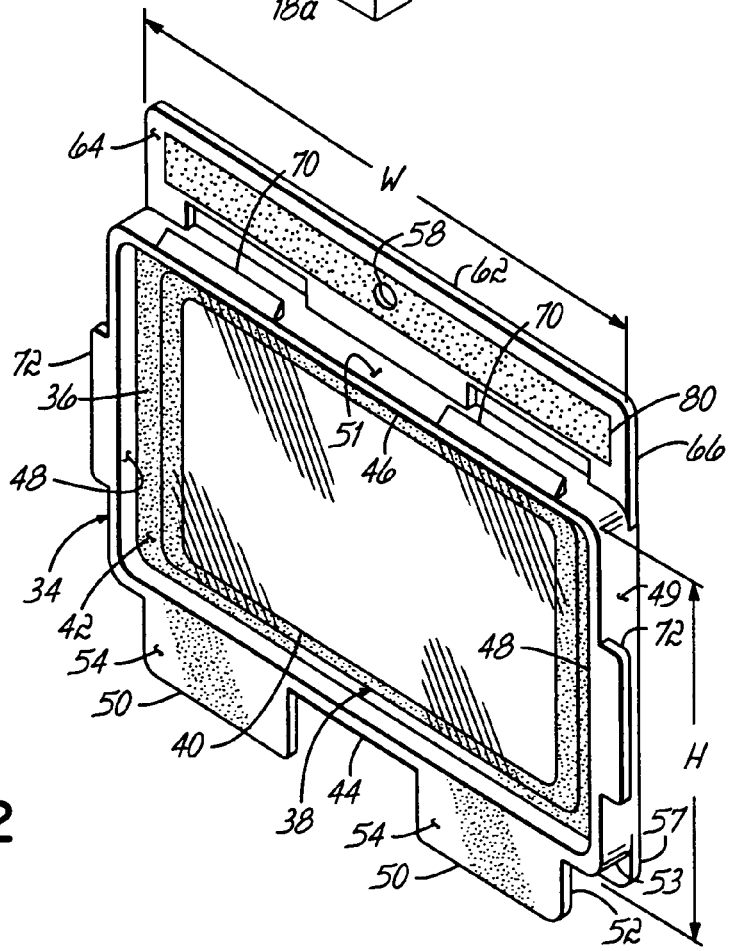
FIG. 2 is a perspective view of the injection molded label holder of the present invention.

Referring to FIG. 2, the injection molded label holder insert 34 is preferably made of one piece of plastic material; however, it may be made of multiple pieces and may be made of any material. The label holder insert 34 comprises a generally rectangular recess 36 adapted to receive a label holder 38 or label. If a label holder is used, the label holder 38 is adapted to receive a label 40 in order to identify the contents of the tote box. The label holder 38 and label 40 are not intended to be a part of the present invention. The injection molded label holder insert 34 of the present invention may be used with any type of label holder. The recess 36 is defined by a generally planar rear portion 42, a lower wall portion 44, an upper wall portion 46 and a pair of side wall portions 48. Each of the wall portions 44, 46 and 48 extend forwardly from the rear portion 42 of the recess 36 around the periphery thereof. Each of the lower, upper and side wall portions 44, 46 and 48 have coplanar forward edges which define the front plane P1 of the insert. See FIG. 3.

As seen in FIG. 2, the insert 34 has a width W which is defined as the distance between the outer surfaces 49 of the side wall portions 48 of the recess 36. The insert 34 also has a height H which is defined as the distance between the outer surface 51 of the upper wall portion 46 and the outer surface 53 of the lower wall portion 44 of the recess 36.

Generally in the front plane P1 of the insert, a pair of spaced front tabs 50 extend downwardly from the lower wall portion 44 of the recess 36. Each of the front tabs 50 have an inside surface 52 adapted to abut the outer surface 28 of the tote box wall 26*b* and an outer surface 54 upon which indicia (not shown) may be printed or otherwise located.

Figure 3:
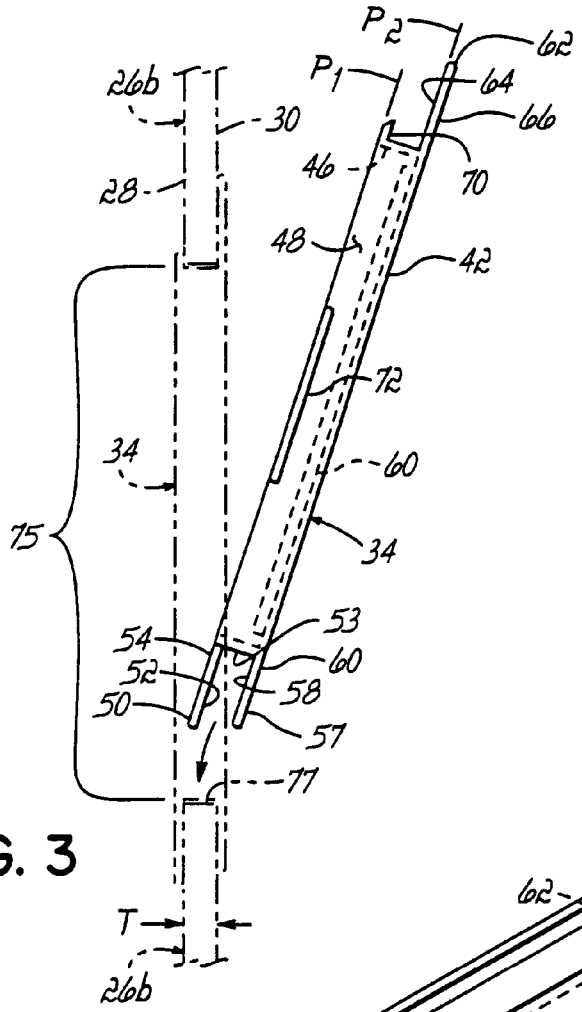
FIG. 3 is a side elevational view of the injection molded label holder of FIG. 2.
Figure 4:
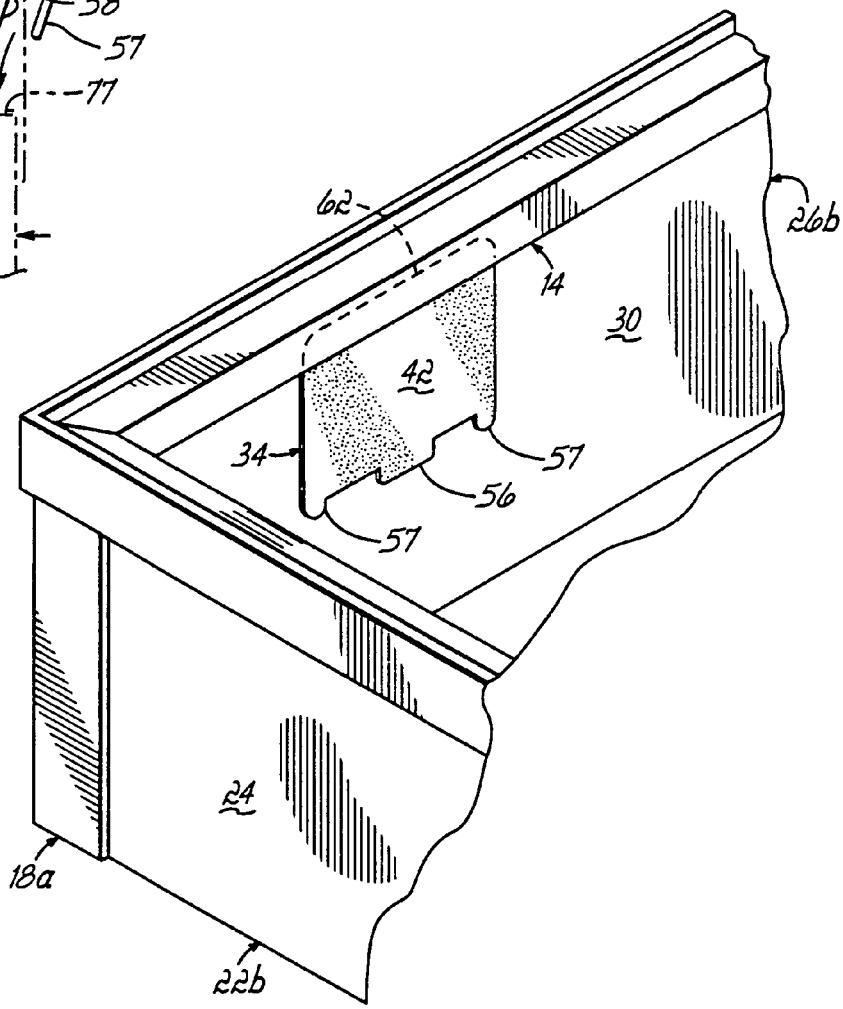
FIG. 4 is a perspective view partially broken away of a tote box with an injection molded label holder located proximate the top of the tote box.

As best seen in FIGS. 3 and 4, a pair of outer rear tabs 57 and a middle rear tab 56 therebetween extend downwardly from the rear portion 42 of the recess 36. Each rear tab 56, 57 has an inside surface 58 adapted to abut the inner surface 30 of the tote box wall 26*b* and an outer surface 60. Each outer surface 60 extends downwardly from the lower wall portion 44 of the recess 36. The outer rear tabs 57 and middle rear tab 56 each is spaced rearwardly of the front tabs 50 a distance equal to the thickness T of the tote box wall 26*b*, i.e. the linear distance between the inner and outer surfaces 30, 28 of the tote box wall 26*b*.

The pair of outer rear tabs 57 extend downwardly from the lower wall portion 44 of the recess 36 outside of the middle rear tab 56. Like the middle rear tab 56, the outer rear tabs 57 are spaced rearwardly of the front tabs 50 a distance equal to the thickness T of the tote box wall 26*b*, i.e. the linear distance between the inner and outer surfaces 30, 28 of the tote box wall 26*b*.

Another portion of the injection molded label holder insert 34 comprises a top flange 62 extending upwardly from the rear portion 42 of the recess 36. The top flange 62 extends the full width W of the insert 34, the distance between the outer surfaces 49 of the side wall portions 48 of the recess 36. As shown in FIG. 3, the top flange 62 has an inner surface 64 which is adapted to abut the inner surface 30 of the tote box wall 26*b* and an outer surface 66. The top flange 62 is generally coplanar with the rear tabs 56, 57 in a rear plane P2 of the insert 34. A rivet hole 68 is centrally located and passes through the top flange 62.

Spaced a distance equal to the thickness T of the tote box wall 26*b* in front of the top flange 62 are a pair of spaced catches 70. The catches 70 are located generally in the front plane P1 of the insert 34 and are adapted to abut the outer surface 28 of the tote box wall 26*b* when the insert 34 is snapped into place.

Lastly a pair of side tabs 72 extend outwardly from the front edge of the side walls 48 of the recess 36. These side tabs 72 are located generally in the front plane P1 of the insert 34 and are adapted to abut the outer surface 28 of the tote box wall 26*b* when the insert 34 is snapped into place.

The method of inserting the injection molded label holder insert 34 of the present invention into the opening of the tote box wall is best illustrated in FIG. 3. As shown in FIG. 3, the insert 34 is located on the inside of the tote box 10 and passed through an opening 75 in the tote box wall 26*b*. More particularly, the pair of spaced front tabs 50 extending downwardly from the lower wall portion 44 of the recess 36 are located in front of the tote box wall 26*b* such that said tote box wall is trapped between the rear tabs 56, 57 extending downwardly from the lower wall portion 44 of the recess 36 and the front tabs 50. In this position, the lower edge 77 of the opening 75 abuts the outer surface of the lower wall portion 44 of the recess 36. The side tabs 72 are then passed through the opening 75 in the tote box wall 26*b*.

Once the insert 34 is properly seated, the side tabs 72 abut the outer surface 28 of the tote box wall 26*b*. The spaced catches 70 extending upwardly from the upper wall portion 46 of the recess 36 are then passed or snapped through the opening 75 in the tote box wall 26*b* such that the tote box wall 26*b* is trapped between the top flange 62 and the catches 70.

The last step in the process is securing the top flange 62 to the tote box wall 26*b* with double sided adhesive tape 80 as shown in FIG. 2, a rivet (not shown) or a sonic weld (not shown). As an alternative to any of these method the top flange 62 of the insert 34 may be trapped underneath the top rail 14 of the tote box in the manner illustrated in FIG. 4.

When the insert 34 is secured in place, the recess 36 is located generally inside the wall 26*b* of the tote box 10. As shown in FIG. 3, a label or label holder located in the recess 36 is prevented from being caught on passing objects using the insert 34 of this invention.

Figure 5:
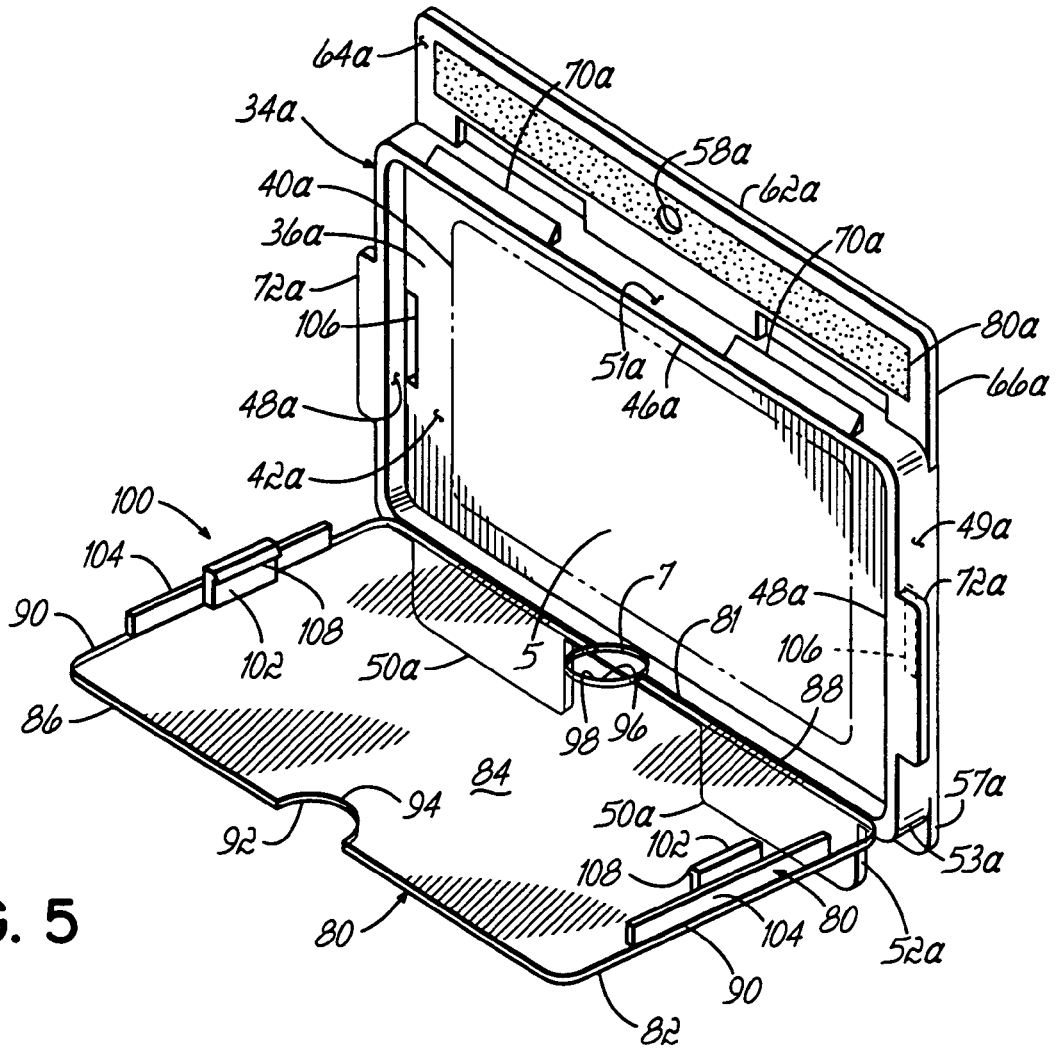
FIG. 5 is a perspective view of an alternative embodiment of the injection molded label holder of the present invention.

FIG. 5 illustrates an alternative preferred embodiment of the present invention. For the sake of simplicity, where possible, like numbers will be used for like parts, but the letter designation "a" will be used to describe this preferred embodiment.

In this preferred embodiment a cover 80 is hingedly secured to the recess 36*a* along a living hinge 81. More particularly, the cover 80 is hinged to the lower wall portion 44*a* of the recess 36*a*. The cover 80 is movable between an open position shown in FIG. 5 and a closed position (not shown). The cover 80 has a outer surface 82, an inner surface 84, an upper edge 86, a lower edge 88 and a pair of side edges 90. The cover 80 has a finger hole 92 which helps the operator open the cover 80 when the cover 80 is locked in a closed position covering a front opening 5 of the recess 36*a*. The finger hole 92 has an arcuate edge 94 which extends inwardly from the upper edge 86 of the cover 80. The finger hole 92 in the cover allows an operator to open the cover 80 when desired by inserting a finger therein and pulling the cover 80 outwardly with sufficient force to overcome a locking mechanism 100 which will be described in detail below.

Similarly, the cover 80 has a second finger hole 96 along the bottom of the cover 80. This finger hole 96 has an arcuate edge 98 which extends inwardly from the lower edge 88 of the cover 80. This finger hole 96 is located and sized to mate or correspond with an opening 7 in the lower wall portion 44*a* of the recess 36*a*. The opening 96 in the cover in conjunction with the opening 7 allows an operator to open the cover 80 when desired by inserting a finger therein and pulling the cover outwardly with sufficient force to overcome a locking mechanism 100.

The locking mechanism 100 functions to lock the cover 80 in a closed position. The locking mechanism 100 comprises two catches 102, one on each side of the cover 80. Each catch 102 extends outwardly from the inner surface 84 of the cover 80 immediately inside a generally rectangular blocking member 104. Each blocking member 104 is sized to abut the rear portion 42*a* of the recess 36*a* immediately inside the side wall portions 48*a* of the recess 36*a* when the cover 80 is in its closed position. The blocking members 104 prevent the cover 80 from closing too much, ensuring that the outer surface 82 of the cover 80 is generally co-planar with the side tabs 72*a* of the recess 34*a* and generally parallel the front plane P1 (see FIG. 3).

Each catch 102 is adapted to be received inside an opening 106 in the rear portion 42*a* of the recess 36*a*. Each catch 102 has a lip 108 adapted to abut the rear portion 42*a* of the recess 36*a* and lock the cover 80 in its closed position until an operator applies sufficient force via one of the finger holes 92, 96 to release the catch 102 from engagement with the rear portion 42*a* of the recess 36*a*. When locked in its closed position, the cover 80 may protect a label 40*a* located in the recess 36*a* from the elements.

The cover 80 is preferably made of a clear plastic material to enable one to easily read the label 40*a* located in the recess 36*a*. However, the cover 80 may be made of any desired material.

While we have described several preferred embodiments of the present invention, persons skilled in the art will appreciate changes and modifications which may be made without departing from the spirit of the invention. For example, although one configuration of tote box 14 is illustrated and described, the present invention may be used with other configurations of boxes. Therefore, we intend to be limited only by the scope of the following claims and equivalents thereof:

We claim:

1. In combination:

a box; and an injection molded label holder insert secured in an opening in a wall of said box, said insert comprising a generally rectangular recess adapted to receive a label holder, said rectangular recess being defined by a rear portion, a lower wall portion extending forwardly from said rear portion, an upper wall portion extending forwardly from said rear portion and a pair of side wall portions extending forwardly from said rear portion, a pair of spaced front tabs extending downwardly from said lower wall portion, a rear tab extending downwardly from said lower wall portion between said front tabs, a pair of side tabs extending outwardly from said sidewall portions of said recess, a top flange extending upwardly from said rear potion of said recess, and a pair of spaced catches extending upwardly from said upper wall portion of said recess, wherein said wall of said box is received between said front and rear tabs of said insert and between said top flange and said catches.

2. In combination:

a box; and an injection molded label holder insert secured in an opening in a wall of said box, said insert comprising a generally rectangular recess having a rear portion, a lower wall portion extending forwardly from said rear portion, an upper wall portion extending forwardly from said rear portion and a pair of side wall portions extending forwardly from said rear portion, a pair of spaced front tabs extending downwardly from said lower wall portion, a rear tab extending downwardly from said lower wall portion between said front tabs, a top flange extending upwardly from said rear potion of said recess, and a pair of spaced catches extending upwardly from said upper wall portion of said recess, wherein said wall of said box is received between said front and rear tabs of said insert and between said top flange and said catches.

3. The combination of claim 2 further comprising a pair of side tabs extending outwardly from said side wall portions of said recess.

4. In combination:

a box; and an injection molded insert secured in an opening in a wall of a box, said insert comprising a generally rectangular recess adapted to receive a label, said rectangular recess being defined by a rear portion, a lower wall portion extending forwardly from said rear portion, an upper wall portion extending forwardly from said rear portion and a pair of side wall portions extending forwardly from said rear portion, at least one front tab extending downwardly from said lower wall portion, a rear tab extending downwardly from said lower wall portion, a top flange extending upwardly from said rear potion of said recess, and a pair of spaced catches extending upwardly from said upper wall portion of said recess, and a cover, wherein said wall of said box is received between said front and rear tabs of said insert and between said top flange and said catches.

5. The combination of claim 4 further comprising a pair of side tabs extending outwardly from said sidewall portions of said recess.

6. The combination of claim 4 wherein said cover is hinged along a bottom edge of said cover to said lower wall portion of said recess.

7. A method of securing an injection molded label holder insert in an opening in a wall of a box, said insert having a generally rectangular recess adapted to receive a label holder, said rectangular recess being defined by a rear portion and four sidewall portions extending forwardly from said rear portion, said sidewall portions including lower wall portion, an upper wall portion and a pair of sidewall portions, said method comprising:

locating a pair of spaced front tabs extending downwardly from said lower wall portion of said recess in front of said box wall such that said box wall is trapped between a rear tab extending downwardly from said lower wall portion of said recess between said front tabs and said front tabs, passing a pair of side tabs extending outwardly from said sidewall portions of said recess through said opening in said box wall, and pushing a pair of spaced catches extending upwardly from said upper wall portion of said recess through said opening in said box wall such that said box wall is trapped between a top flange extending upwardly from said rear portion of said recess and said catches.

8. The method of claim 7 further comprising the step of rivoting said top flange of said insert to said box wall.

9. The method of claim 7 further comprising the step of taping said top flange of said insert to said box wall.

10. The method of claim 7 further comprising the step of welding said top flange of said insert to said box wall.

11. A method of securing an injection molded insert in an opening in a wall of a box, said insert having a generally rectangular recess adapted to receive a label and a cover for said recess, said rectangular recess being defined by a rear portion, a lower wall portion, an upper wall portion and a pair of sidewall portions, said method comprising:

locating a pair of spaced front tabs extending downwardly from said lower wall portion of said recess in front of said box wall such that said box wall is trapped between a rear tab extending downwardly from said lower wall portion of said recess and said front tabs, passing a pair of side tabs extending outwardly from said sidewall portions of said recess through said opening in said box wall, pushing a pair of spaced catches extending upwardly from said upper wall portion of said recess through said opening in said box wall such that said box wall is trapped between a top flange extending upwardly from said rear portion of said recess and said catches.

12. The method of claim 11 further comprising securing a cover over said recess.

13. In combination:

a container; and an injection molded label holder insert secured in an opening in a wall of said container, said insert comprising a recess adapted to receive a label holder, said recess being defined by a rear portion and upper, lower and side wall portions extending forwardly from said rear portion, front tabs extending downwardly from said lower wall portion of said recess, at least one rear tab spaced behind said front tabs and extending downwardly from said lower wall portion of said recess, a top flange extending upwardly from said rear portion of said recess, and catches extending upwardly from said upper wall portion of said recess, wherein said wall of said container is received between said front and rear tabs of said insert and between said top flange and said catches.

14. The combination of claim 13 said insert further comprising a pair of side tabs extending outwardly from said sidewall portions of said recess.

* * * * *

UNITED STATES PATENT AND TRADEMARK OFFICE

CERTIFICATE OF CORRECTION

PATENT NO. : 6,959,507 B2
DATED : November 1, 2005
INVENTOR(S) : Donald J. Bazany et al.

It is certified that error appears in the above-identified patent and that said Letters Patent is hereby corrected as shown below:

Column 1,
Lines 34 and 36, change “applicant’s” to -- applicants’ --.
Line 45, change “container such a” to -- container such as a --.

Column 2,
Line 13, change “rivot” to -- rivet --.
Line 44, change “rivoted” to -- riveted --.

Column 5,
Line 36, change “method” to -- methods --.

Column 7,
Line 64, change “front tabs” to -- rear tab --.

Column 8,
Line 10, change “rivoting” to -- riveting --.
Line 57, insert a -- , -- after “claim 13”.

Signed and Sealed this

Eleventh Day of April, 2006

JON W. DUDAS
*Director of the United States Patent and Trademark Office*